United States Patent [19]

Chandler

[11] 4,387,940

[45] Jun. 14, 1983

[54] APPARATUS FOR SUPPORTINGLY ORGANIZING AND DISPLAYING MISCELLANEOUS ARTICLES

[76] Inventor: Earl E. Chandler, P.O. Box 1624, Coolidge, Ariz. 85228

[21] Appl. No.: 229,339

[22] Filed: Jan. 29, 1981

Related U.S. Application Data

[63] Continuation-in-part of Ser. No. 123,387, Feb. 21, 1980, Pat. No. 4,273,394, which is a continuation-in-part of Ser. No. 937,543, Aug. 28, 1978, Pat. No. 4,225,202.

[51] Int. Cl.[3] ..... A47B 63/00; A47F 5/08; A47B 96/06

[52] U.S. Cl. ..... 312/184; 206/349; 211/96; 223/107; 312/DIG. 33

[58] Field of Search ..... 312/244, 184, 189, DIG. 33, 312/294; 211/96, 57.1, 59.1, 168; 206/349, 372, 373; 223/107; 217/62; 220/4 R

[56] References Cited

U.S. PATENT DOCUMENTS

| | | | |
|---|---|---|---|
| 3,831,805 | 8/1974 | Yonce | 312/DIG. 33 |
| 4,170,392 | 10/1979 | Spevak | 312/DIG. 33 |
| 4,286,832 | 9/1981 | Spevak | 312/DIG. 33 |
| 4,339,164 | 7/1982 | Spevak | 206/373 |

FOREIGN PATENT DOCUMENTS

| | | | |
|---|---|---|---|
| 704061 | 12/1956 | United Kingdom | 312/DIG. 33 |

*Primary Examiner*—Alexander Grosz
*Attorney, Agent, or Firm*—Herbert E. Haynes, Jr.

[57] ABSTRACT

An especially configured carrying box has a plurality of cantilever arms demountably and pivotably mounted therein and display panels are demountably suspended from the cantilever arms. The display panels have fastener devices thereon for demountably supporting miscellaneous articles in organized arrays.

8 Claims, 6 Drawing Figures

FIG-2
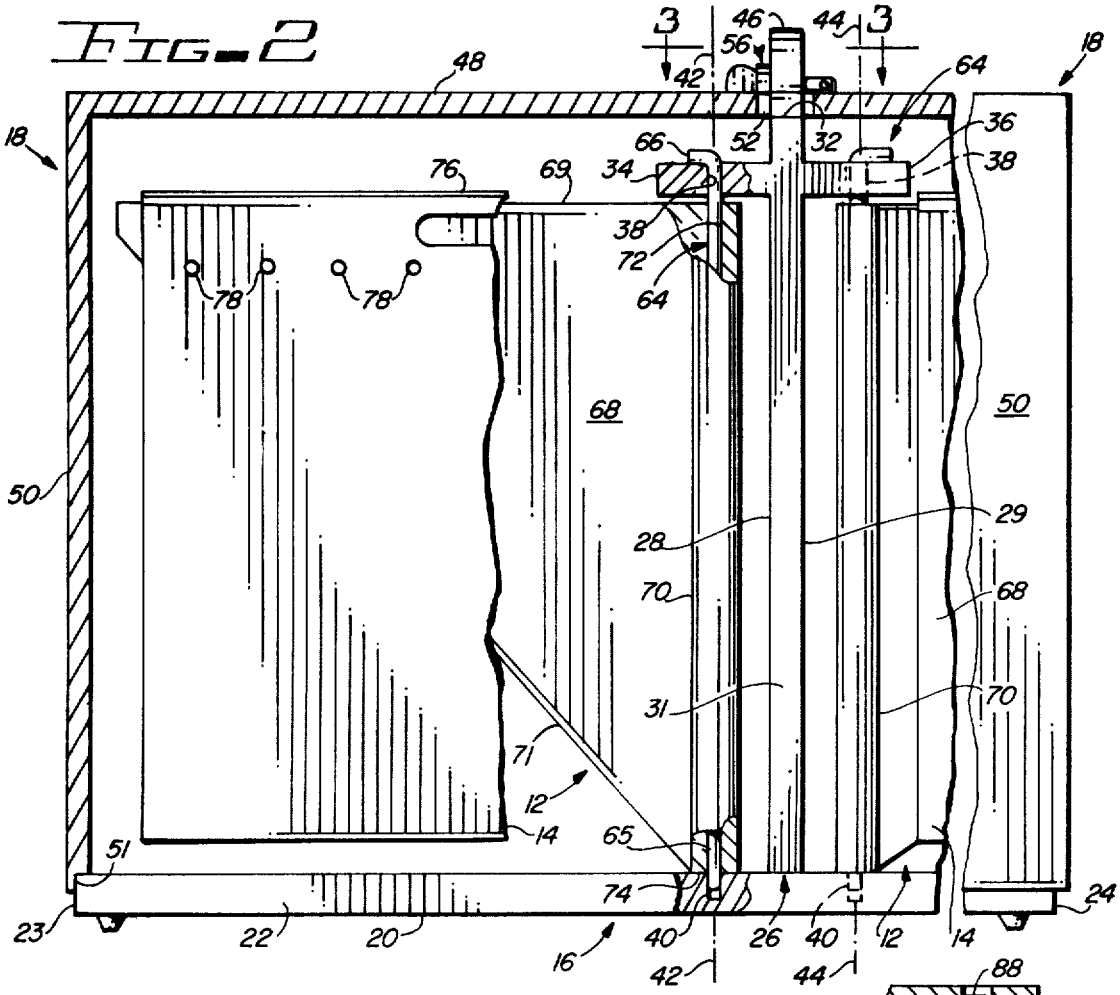
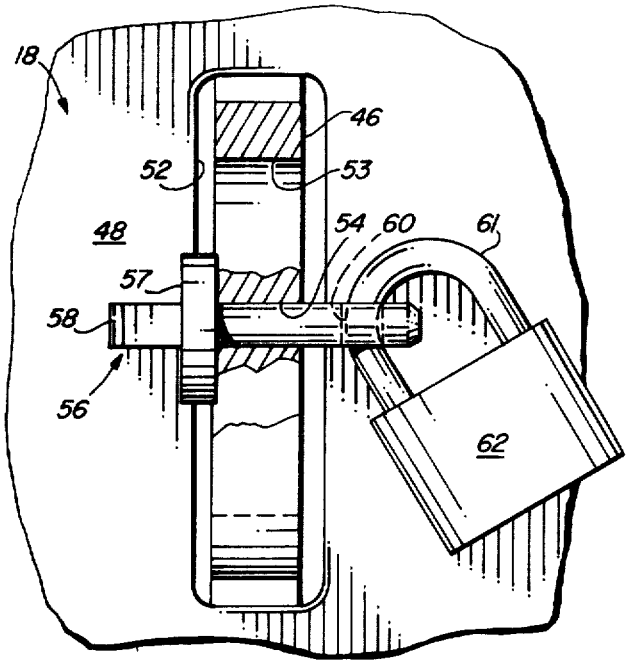
FIG-3
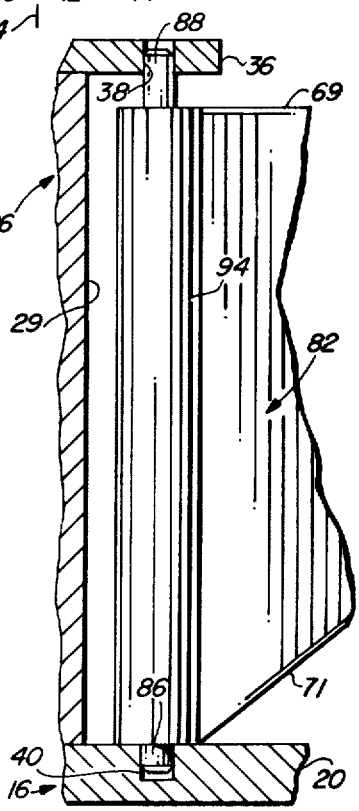
FIG-4

APPARATUS FOR SUPPORTINGLY ORGANIZING AND DISPLAYING MISCELLANEOUS ARTICLES

CROSS-REFERENCE TO RELATED APPLICATIONS

This application is a Continuation-In-Part of a copending U.S. patent application Ser. No. 123,387, filed on Feb. 21, 1980, now U.S. Pat. No. 4,273,394 for APPARATUS FOR SUPPORTINGLY ORGANIZING AND DISPLAYING MISCELLANEOUS ARTICLES, which is in turn a Continuation-In-Part of U.S. patent application Ser. No. 937,543, filed on Aug. 28, 1978, for APPARATUS FOR SUPPORTINGLY ORGANIZING AND DISPLAYING MISCELLANEOUS ARTICLES, which issued as U.S. Pat. No. 4,225,202 on Sept. 30, 1980, all by the same inventor.

BACKGROUND OF THE INVENTION

1. Field of the Invention

This invention relates to article supporting structures and more particularly to an apparatus for demountably supporting and displaying miscellaneous articles.

2. Description of the Prior Art

Many article supporting and/or carrying structures have been devised for various articles such as tools, fishing tackle, sewing supplies, and the like, with those prior art structures most often being in the form of a box with a hinged lid and having a multiplicity of trays, drawers, or other compartments formed therein. Such structures, although serving the purpose, are not always convenient to use in that the various types of compartments usually contain a multiplicity of articles which can make access to an individual article somewhat difficult and often delays locating of a desired one of the articles.

In addition to box shaped article carrying structures, the prior art is replete with cabinet structures for containing various articles which are usually supported on shelves or contained within drawers. These cabinet structures often provide the same difficulties as the above described boxes with regard to access to and location of individual articles.

In general, the prior art article supporting and/or carrying structures make no provisions for organized display of the various articles either within the structure or externally thereof, but simply contains those articles in a more or less disorganized manner.

Therefore, it is desirable to provide a new and useful apparatus for supportingly displaying and/or carrying various articles which overcomes some of the problems and shortcomings of the prior art.

SUMMARY OF THE INVENTION

In accordance with the present invention, an apparatus is disclosed for supporting and/or carrying miscellaneous articles in an organized display-like arrangement. The apparatus includes an especially configured carrying box having a base comprising a floor and a centrally located upstanding partition, or wall, and having a cover which includes a top and four depending walls. The cover is demountably attachable to the base and is provided with a handle by which the entire case may be carried.

A plurality of cantilever arm means are demountably and pivotably attached to each of the opposite sides of the centrally located upstanding wall of the base, and are disposed thereon so as to be spaced above the floor of the base. Planar display panels are suspendingly carried on the cantilever arm means so as to depend therefrom toward the floor of the base of the carrying box, and the display panels are provided with fastener means for supportingly carrying miscellaneous articles in organized arrays. The display panels are individually mountable so that they may be easily removed from their cantilever arms for remote display purposes, or to provide improved access to the individual articles carried thereon.

The above described apparatus may be physically sized so that it is suitable for being carried from place to place as herein before mentioned, or it may be sized to supportingly carry relatively large numbers of bulky and rather large articles such as mechanics tools. When this is the case, the apparatus may be provided with suitable casters and may be modified to suitably accomodate the articles that are to be carried.

When the size and weight of the apparatus of the present invention is of little or no concern, the centrally located upstanding wall may be configured so that it supports containment means such as drawers, shelves, bins and the like for storing items which are not ideally suited for being carried on the display panels such as power tools and the like. Further, the height of the centrally located upstanding wall may be increased so that it can accomodate plural tiers of the centilever arm means and thus provide means for demountably supporting increased numbers of the display panels.

Accordingly, it is an object of the present invention to provide a new and improved article supporting and displaying apparatus.

Another object of the present invention is to provide a new and improved article supporting and displaying apparatus which is inexpensive to manufacture and simple to use.

Another object of the present invention is to provide a new and improved article supporting and displaying apparatus in which various miscellaneous articles are demountably supported in organized arrays on removable display panels.

Another object of the present invention is to provide a new and improved article supporting and displaying apparatus of the above described character in which the individual display panels are demountably carried on cantilever arms which are pivotably and demountably carried in an especially configured carrying box.

Another object of the present invention is to provide a new and improved article supporting and displaying apparatus of the above described character wherein the special carrying box includes a base comprising a floor with a centrally located upstanding wall or partition on which the cantilever arms are demountably and pivotably carried so as to extend from both of the opposite planar surfaces thereof, and a demountable cover.

Another object of the present invention is to provide a new and improved article supporting and displaying apparatus of the above described type wherein the centrally located upstanding wall of the base is provided with containment means such as drawers, shelves, bins and the like.

Still another object of the present invention is to provide a new and improved article supporting and displaying apparatus of the above described character wherein the centrally located upstanding wall of the base of configured to support plural tiers of the cantilever arm means.

The foregoing and other objects of the present invention, as well as the invention itself, may be more fully understood from the following description when read in conjunction with the accompanying drawings.

BRIEF DESCRIPTION OF THE DRAWINGS

FIG. 2 is a fragmentary longitudinal sectional view taken along a vertical plane which passes through the assembled apparatus of the present invention, with portions of the apparatus being broken away to show the various features thereof.

FIG. 3 is an enlarged fragmentary sectional view taken along the line 3—3 of FIG. 2.

FIG. 4 is an enlarged fragmentary sectional view illustrating a modification of the apparatus shown in FIGS. 1 and 2.

DESCRIPTION OF THE PREFERRED EMBODIMENTS

Figure 1:
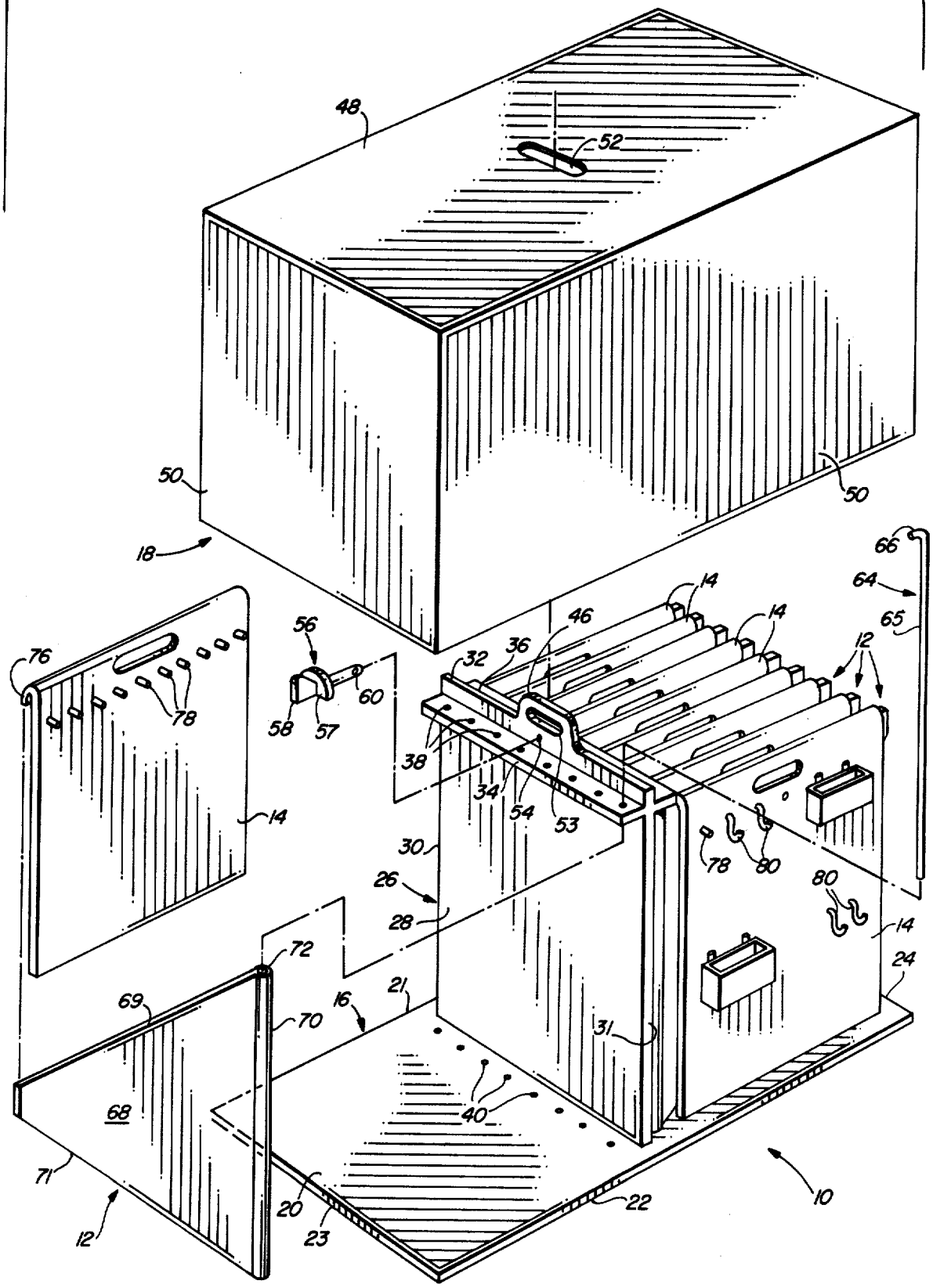
FIG. 1 is an exploded perspective view of the apparatus of the present invention showing the various features of the especially configured carrying box and showing a typical one of the cantilever arm means and a typical one of the display panel means as being exploded therefrom.

Referring more particularly to the drawings, FIG. 1 illustrates the article supporting and display apparatus of the present invention as including a special carrying box which is indicated generally by the reference numeral 10. FIG. 1 also illustrates, in exploded relationship, a typical one of a plurality of cantilever arm means 12 and a typical one of a plurality of display/organizer panel means 14, which are demountably and pivotably carried in the box 10 as will hereinafter be described in detail.

The special box 10 includes a base 16 and a cover 18 for demountable interconnection. The base 16 has a planar floor 20 of generally rectangular configuration with opposed longitudinal side edges 21 and 22 and opposed end edges 23 and 24. As will hereinafter be described in detail, a centrally located upstanding wall, or partition 26, is an integral part of the planar floor 20 and is disposed thereon transverse with respect to the floor so as to extend substantially between the longitudinal side edges 21 and 22 of the floor.

The upstanding wall 26 is a substantially planar structure having oppositely facing planar surfaces 28 and 29, side edges 30 and 31 and a top edge 32. A first elongated plate, or ledge 34, extends normally from the planar surface 28 adjacent the top edge of the wall 26 and a second plate, or ledge 36, similarly extends from the planar surface 29 of the wall. These plates 34 and 36 therefore extend oppositely from the upstanding wall 26 and are in parallel spaced relationship with respect to the floor 20 of the base 16. As will hereinafter be described, each of the plates 34 and 36 has a plurality of apertures 38 formed therethrough and arranged in spaced increments along their lengths. Likewise, the floor 20 of the base 16 has a similar number of apertures 40 formed therein with each of the apertures 40 lying on a vertical axis which is common with one of the apertures 38 of the oppositely extending plates 34 and 36. Therefore, the base 16 of the box 10 defines a plurality of laterally spaced vertically extending axes on each of the opposite sides of the upstanding wall 26, with typical ones of those axes being shown at 42 and 44 in FIG. 2, with each of the axes 42 and 44 having one set of apertures lying thereon, with one set of apertures including one of the apertures 38 and one of the apertures 40.

The upstanding wall 26 is also provided with an integral tongue-shaped protrusion 46 which extends upwardly from the midpoint of the top edge 32 and serves as a handle and means for locking the carrying case 10 as will hereinafter be described.

The cover 18 is formed with a planar top 48 which is of the same size and shape as the floor 20 of the base 16, and has integral depending walls which define an endless sidewall 50. As shown in FIG. 2, an endless notch-shaped groove 51 is formed in the depending edge of the sidewall 50 of the cover 18 for supporting the cover in resting engagement on the upwardly facing peripheral edge of the floor 20 when the cover is mounted on the base 16.

The top 48 of the cover 18 has an elongated slot 52 centrally formed therethrough for receiving the upstanding protrusion 46 of the central wall 26 of the base 16 when the cover is mounted thereon. As seen best in FIGS. 2 and 3, the protrusion 46 extends through the top slot 52 and has an elongated opening 53 formed therein for receiving the hand (not shown) of a person who is to carry the case 10. The tongue-shaped protrusion 46 also has an aperture 54 formed therethrough below the hand receiving opening 53 and a locking pin 56 is demountably insertable in that aperture. The locking pin 56 is configured so that when it is inserted in the aperture 54, it will span the slot 52 of the cover top 48 and be in bearing engagement with the top. The locking pin has a stop plate 57 on one end thereof to prevent the pin from passing all the way through the aperture 54 and a finger pull tab 58 is provided on that same end of the locking pin. The opposite end of the locking pin 56 is provided with an aperture 60 for receiving the staple portion 61 of a conventional padlock 62 so that when in place as seen best in FIG. 3, the pin 56 cannot be extracted and thus the cover 18 is locked to the base 16.

The hereinbefore mentioned plurality of cantilever arm means 12 are demountably connected to the opposite sides of the upstanding wall 26 of the base 16, in a manner which will be described, by a plurality of L-shaped pins 64, with there being one pin demountably slidably carried in each set of the apertures 38 and 40. Each of the L-shaped pins 64 includes an elongated shank 65 having a head portion 66 formed on one end thereof by which the pin is grasped for manual sliding insertion into and removal from its respective one of the aperture sets as will be described.

The plurality of cantilever arm means 12 may be equal in number to the number of aperture sets defined in the base 16 of the box 10, and the plurality of cantilever arm means 12 may be identically configured structures. Thus, the following detailed description of one of the cantilever arm means 12 will be understood to apply to each of those structures.

The preferred configuration of the cantilever arm means 12 is shown best in FIGS. 1 and 2 as being a substantially planar member 68 of generally triangular configuration. The planar member 68 is defined by a top horizontal edge 69, a special vertically extending tubular edge 70 having a bore 72 extending therethrough, and a diagonal edge 71. The special tubular edge 70 is preferrably integrally formed on the planar member 68 and has a length dimension which allows the planar member 68 to be positioned as shown in FIG. 2 with its tubular edge 70 adjacent one or the other of the planar surfaces 28 or 29 of the upstanding wall 26 and parallel therewith, with the bore 72 of the tubular edge 70 lying along the appropriate vertical axis 42 or 44. When the cantilever arm means 12 is so positioned, one of the L-shaped pins 64 is slidably inserted through the apertures 38 and 40 of the appropriate one of the aperture sets for demountably and pivotably attaching the centilever arm means 12 to the upstanding wall 26 of the base 16. It will now be seen that each of the cantilever arm means 12 will lie in a vertical plane and may be pivotably moved in an arc about its vertical axis 42 or 44 for access reasons as will become apparent as this description progresses.

As seen best in FIG. 2, a relatively short flat surface 74 is provided on the lowermost part of the planar member 68 at the place where the tubular edge 70 and the diagonal edge 71 would otherwise intersect. The flat surface 74 is in bearing engagement with the floor 20 of the base which, in conjunction with the two-point mounting arrangement of the planar member 66, i.e., at apertures 38 and 40, will rigidly mount the cantilever arm means 12 in the box 10 in a manner which will resist downward deflection thereof when the centilever arm 12 is supporting the load of the display panel means 14 as will now be described.

The plurality of display/organizer panel means 14, which may be equal in number to the number of cantilever arm means 12, are each of planar configuration and may be fabricated of any suitable material such as wood, plastic, metal, fabric and the like, with the choice of such materials being determined by the articles that are to be displayingly carried thereon.

Each of the display panels 14 has one edge thereof bent back upon itself to form a longitudinally extending hook 76. The panels 14 are demountably suspended from the cantilever arm means 12 by looping their longitudinally extending edge hooks 76 over the top horizontal edges 69 of the cantilever arms 12.

As shown, the display/organizer panel means 14 are each provided with fastener means thereon such as: projecting pegs 78, hooks 80 and other similar devices with the particular devices and arrangement being determined by the articles that are to be carried thereon.

Referring now to FIG. 4, wherein a modified form of cantilever arm means 82 is shown. The cantilever arm means 82 has its vertical edge 84 of solid configuration as opposed to the tubular edge 70 of the previously described cantilever arm means 12. A relatively short pin 86 is integral with and depends axially from the solid vertical edge 94 for insertion into one of the apertures 40 formed in the floor 20 of the base 16. A somewhat longer pin 88 is integral with and extends axially upwardly from the solid vertical edge 94 of the cantilever arm 82 for insertion into the aligned aperture 38 formed through the plate 34 or 36 at the upper end of the upstanding wall 26. With the cantilever arm 82 mounted as shown in FIG. 4, it may be removed from the aperture set defined by the apertures 38 and 40 by lifting up on the arm until the short bottom pin 86 clears the aperture 40 which allows the arm to be tilted so that it can be moved down to extract the top pin 88 from the aperture 38. Mounting of the cantilever arm 82 is accomplished by reversing the steps of the above described removal proceedure.

Figure 5:
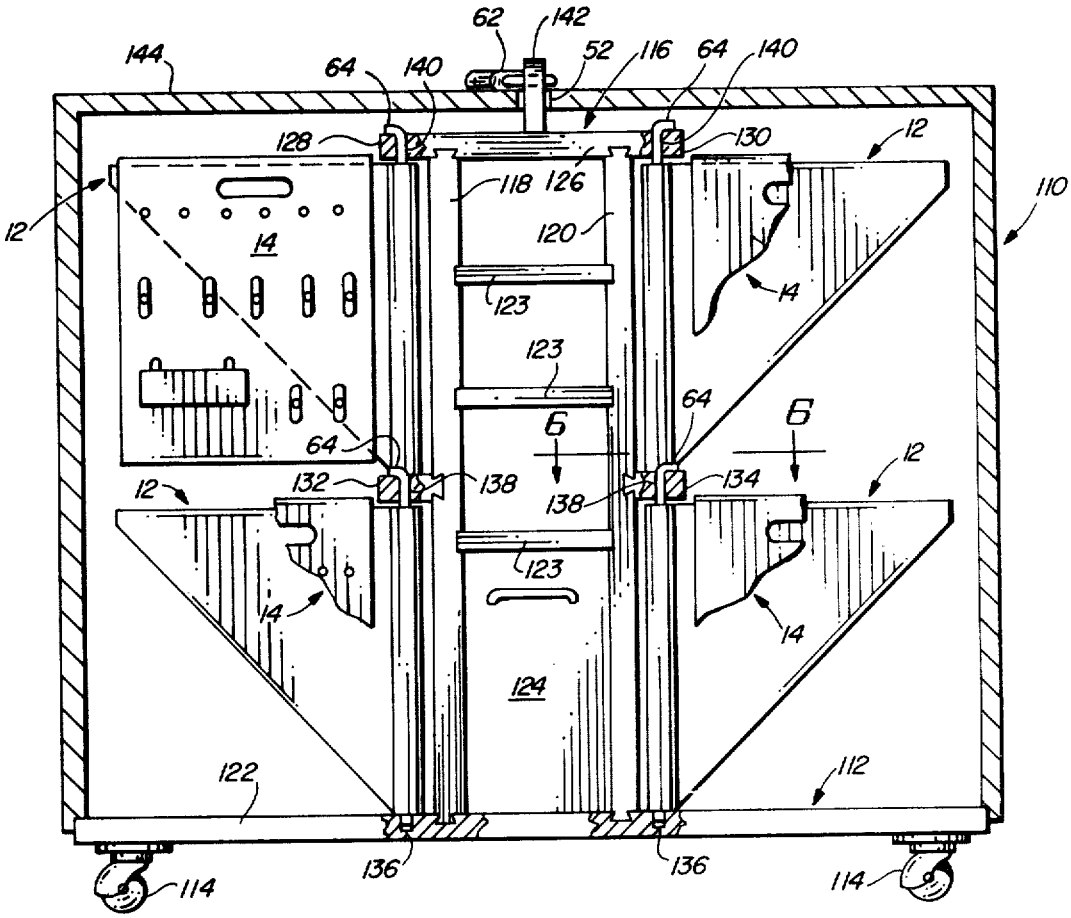
FIG. 5 is a sectional view similar to FIG. 2 and illustrating a second embodiment of the apparatus of the present invention.
Figure 6:
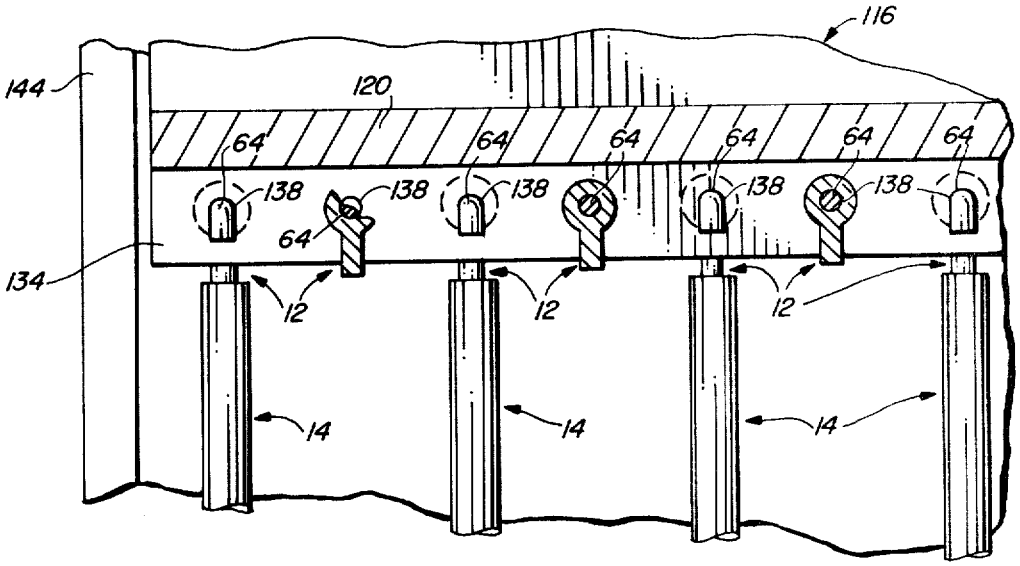
FIG. 6 is an enlarged fragmentary sectional view taken along the line 6—6 of FIG. 5.

As hereinbefore mentioned, the apparatus of the present invention may be made larger in size and weight than could conceivably be carried by a single person, and such a structure along with some modifications, as compared to the previously described carrying case 10, is illustrated in FIGS. 5 and 6.

The modified case 110 is provided with a base 112 having suitable casters 114 and an upstanding central wall 116. In this embodiment, the upstanding central wall 116 includes a spaced pair of upstanding planar structural members 118 and 120 both of which extend transversely across the floor 122 of the base 112 with the space between the planar structural members having containment means therein such as the illustrated shelves 123 and the sliding drawer 124.

The upper edges of the spaced planar structural members 118 and 120 are interconnected by a flat plate 126 which spans the space between the structural members and extends slightly beyond so that the oppositely extending portions 128 and 130 serve the same purpose as the previously described plates 34 and 36 of the carrying case 10.

The above described upstanding central wall 116 may be fabricated with a height dimension suitable for carrying plural tiers of centilever arm means 12 and their associated display/organizer panels 14. When this is the case, the spaced planar structural members 118 and 120 are provided with intermediate plates 132 and 134 which extend normally from their respective planar structural members at a point substantially mid way between the floor 122 and the upper end of the upstanding wall 116.

As was the case in the previously described carrying box 10, the floor 122 of the box 110 is provided with a plurality of apertures 136 aligningly arranged adjacent each of the planar structural members 118 and 120. The intermediate plates 132 and 134 are also provided with plural apertures 138 aligningly arranged along their lengths and the extending portions 128 and 130 of the flat plate 126 are each similarly provided with plural apertures 140. Therefore, the cantilever arm means 12 are demountably and pivotably attached to the upstanding central wall 116 in the previously described manner so as to extend oppositely from the wall.

Due to the provision for mounting plural tiers of the cantilever arm means 12 and their demountably carried display/organizer panels 14, an alternately staggered mounting arrangement is needed as shown in FIG. 6. As shown, a first one of the apertures 138 of the intermediate plate 134 receives one of the L-shaped pins 64 to mount one of the cantilever arm means 12 in the lower tier. The immediately adjacent, or second, aperture 138 of the intermediate plate 134 receives the lower portion of another one of the pins 64 to mount the next cantilever arm means 12 in the upper tier. This alternate mounting arrangement is employed for all of the cantilever arm means to permit the use of multiple tiers, and it will be understood that any convenient number of tiers may be employed.

Since the box 110 is intended to be pushed from place to place rather than carried, the upstanding tongue-like protrusion 142 is configured to serve only as means for locking the cover 144 to the base 112, with this being accomplished by simply coupling the padlock 62 directly to the protrusion 142 immediately above the slot 52 provided in the cover.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles.

The appended claims are therefore intended to cover and embrace any such modifications within the limits only of the true spirit and scope of the invention.

What I claim is:

1. An apparatus for supportingly displaying miscellaneous articles in organized arrays comprising:

(a) a box including,

I. a base having a floor with a transverse upstanding central wall,

II. a cover demountably mounted on said base for enclosing said base, (b) at least a pair of cantilever arm means each having an elongated horizontal top edge and an elongated vertical side edge;

(c) means on the upstanding central wall and in the floor of said base and on said pair of cantilever arm means for demountably and pivotably mounting said pair of cantilever arm means in said box so that the elongated vertical side edge of one of said pair of cantilever arm means lies along a first vertical axis which is adjacent one side of the upstanding central wall of said base and the elongated vertical side edge of the other of said pair of cantilever arm means lies along a second vertical axis which is adjacent the other side of the upstanding central wall of said base, said pair of cantilever arm means being pivotably movable about their respective ones of said first and said second vertical axes;

(d) a display panel means demountably suspended from each of said pair of cantilever arm means; and (e) fastener means on said display panel means for demountably supporting miscellaneous articles thereon in organized arrays.

2. An apparatus as claimed in claim 1 wherein said means for mounting said pair of cantilever arm means in said box comprises:

(a) first and second plates on the upstanding central wall of said base and extending normally from opposite sides thereof, said first and second plates being in spaced parallel relationship with respect to the floor of said base and each having at least one aperture formed therethrough;

(b) said floor of said base having a first aperture formed therein in vertical alignment with the aperture formed in said first plate so as to cooperatively define the first vertical axis and having a second aperture formed therein in vertical alignment with the aperture formed in said second plate so as to cooperatively define the second vertical axis;

(c) each of said pair of cantilever arm means having a tubular means on the elongated vertical side edge thereof with one of said pair of cantilever arm means being disposed so that the bore of its tubular means lies along the first vertical axis and the other one of said pair of cantilever arm means being disposed so that the bore of its tubular means lies along the second vertical axis;

(d) first pin means demountably positioned in the aperture of said first plate, the bore of the tubular means of the one of said pair of cantilever arm means and the first aperture formed in the floor of said base; and (e) second pin means demountably positioned in the aperture of said second plate, the bore of the tubular means of the other one of said pair of cantilever arm means and the second aperture formed in the floor of said base.

3. An apparatus as claimed in claim 1 and further comprising:

(a) a projection extending upwardly from the central portion of the top edge of the upstanding central wall of said base;

(b) a slot formed centrally in the top of said cover through which said projection extends when said cover is mounted on said base; and (c) an elongated slot formed through said projection to configure said projection in the shape of a handle.

4. An apparatus as claimed in claim 3 and further comprising:

(a) said projection having an aperture formed therethrough below the slot formed therethrough;

(b) a pin demountably positioned in the aperture of said projection so as to span the slot of said cover; and (c) means for locking said pin in the aperture of said projection.

5. An apparatus as claimed in claim 1 wherein each of said cantilever arm means is of planar generally triangular configuration.

6. An apparatus as claimed in claim 1 wherein said display panel means are of planar configuration having one of their edges bent back upon itself to form an elongated hook by which said display panel means are demountably suspended from said cantilever arm means.

7. An apparatus as claimed in claim 1 and further comprising means on the upstanding central wall of said base for demountably and pivotably mounting plural tiers of said cantilever arm means on each of the opposite sides of the upstanding central wall of said base.

8. An apparatus as claimed in claim 1 and further comprising:

(a) said upstanding central wall of said base including a spaced apart pair of upstanding planar structural members each of which is transverse with respect to the floor of said base; and (b) containment means in the space between said pair of upstanding planar structural members for storage of miscellaneous articles.

* * * * *